US006409020B1

(12) United States Patent
Lo

(10) Patent No.: US 6,409,020 B1
(45) Date of Patent: Jun. 25, 2002

(54) CHILD-RESISTANT BLISTER PACKAGE

(75) Inventor: Julian B. Lo, Old Lyme, CT (US)

(73) Assignee: Pfizer Inc., New York, NY (US)

( * ) Notice: Subject to any disclaimer, the term of this patent is extended or adjusted under 35 U.S.C. 154(b) by 0 days.

(21) Appl. No.: 09/631,578

(22) Filed: Aug. 4, 2000

Related U.S. Application Data

(60) Provisional application No. 60/147,968, filed on Aug. 9, 1999.

(51) Int. Cl.[7] ..... B65D 83/04

(52) U.S. Cl. ..... 206/533; 206/1.5; 221/79; 220/281

(58) Field of Search ..... 206/815, 528, 206/533, 534, 536, 538, 816, 531, 532, 540, 1.5; 221/260, 4, 91, 159, 164, 255, 256, 307, 79, 31, 30, 88, 89; 220/281, 262

(56) References Cited

U.S. PATENT DOCUMENTS

| | | | | |
|---|---|---|---|---|
| 3,143,207 A | * | 8/1964 | Wagner | 206/533 |
| 3,387,699 A | | 6/1968 | Heller | |
| 3,503,493 A | | 3/1970 | Nagy | |
| 3,570,707 A | * | 3/1971 | Finkel | 221/86 |
| 3,621,992 A | | 11/1971 | Osborne et al. | |
| 3,809,221 A | | 5/1974 | Compere | |
| 3,871,551 A | * | 3/1975 | Bender | 206/533 |
| 3,872,970 A | | 3/1975 | Edison | |
| 3,905,479 A | | 9/1975 | Gerner | |
| 3,921,805 A | | 11/1975 | Compere | |
| 4,162,024 A | * | 7/1979 | Shanley | 206/816 |
| 4,216,860 A | | 8/1980 | Heimann | |
| 5,477,981 A | * | 12/1995 | Heyl et al. | 221/86 |
| 5,788,079 A | * | 8/1998 | Bouthiette | 206/534 |

FOREIGN PATENT DOCUMENTS

| | | |
|---|---|---|
| GB | 1576316 | 10/1980 |

* cited by examiner

*Primary Examiner*—Shian Luong
(74) *Attorney, Agent, or Firm*—Peter C. Richardson; Gregg C. Benson; Carl J. Goddard

(57) ABSTRACT

The invention provides a child-resistant apparatus for dispensing articles which comprises a housing for retaining a blister package wherein the, housing comprises a dispensing aperture; optionally, but preferably, a blister package comprising at least one blister cell containing an article to be dispensed; and a substantially rigid backing sheet substantially co-extensive with, and substantially blocking, the dispensing aperture wherein the backing sheet comprises exposed end portions, such that pressure applied on either exposed end portion individually, or on both exposed end portions simultaneously of the backing sheet, imparts arcuate flexure thereto and dislocation thereof from the substantially co-extensive, and substantially blocking position, to a position where the dispensing aperture is unblocked permitting the article contained in the blister cell to be dispensed. Release of pressure on the exposed end portion or portions of the backing sheet relaxes flexure thereof such that the substantially co-extensive, and substantially blocking position, wherein the backing sheet substantially blocks the dispensing aperture, is restored.

4 Claims, 3 Drawing Sheets

CHILD-RESISTANT BLISTER PACKAGE

This application is filed claiming priority from co-pending Provisional Application No. 60/147,968 filed Aug. 9, 1999.

BACKGROUND OF THE INVENTION

The pharmaceutical industry offers a diverse array of dispensers and containers for medications. While governmental regulations require child-resistant caps on bottles and vials containing pharmaceutical products, there exists a general need in the art for a device which is not only child-resistant, but also permits access to the medicaments or other articles contained therein to persons of diminished dexterity or cognitive function.

In recent years, blister packaging has become universally popular not only for medicaments in the form of capsules, pills or lozenges, but also for various electronic and automotive parts and the like. In a conventional blister package dispenser, the articles to be dispensed are sandwiched between a layer of transparent or translucent plastic in the form of a generally outwardly extending cavity or blister cell and a rupturable or puncturable layer. Force applied to the exterior of the outwardly extending blister cell, for example by the pressure of one or more fingers or the thumb of the individual dispensing the article, is transmitted to the article contained therein which subsequently ruptures or punctures the rupturable or puncturable layer. The article may then be removed or otherwise dispensed from the blister cell.

Because the contents of a blister package are generally visible and sometimes highly colored, they can become the targets of inquisitive children who risk substantial injury and/or death if they succeed in opening the package and ingesting or mishandling the contents thereof. Accordingly, it is important to childproof such packaging by rendering it too difficult to open for children while concurrently providing a user-friendly apparatus for use by adults who may be of diminished dexterity or digital function.

Childproof or child-resistant blister packages comprise a diversity of arrangements well-known to one of ordinary skill in the art. Certain of these incorporate so-called "tear-away" or "peel-away" backing strips designed to protect the contents of the blister package from contamination or unintended consumption by children. For example, U.S. Pat. No. 3,809,221 discloses a blister-type package comprising a flexible polymeric backing sheet covering a rupturable sheet of a medicament package. In such packaging, the pill or medicament cannot be forced through the rupturable sheet unless the backing sheet is first torn or peeled away. Other variations incorporating multiple "tear-away" backing sheets are found in U.S. Pat. Nos. 3,503,493; 3,621,992; and 3,387,699. Additional examples of such blister packages are disclosed in, inter alia, British Patent 1,576,316;, U.S. Pat. Nos. 3,872,970; 3,905,479; 3,921,805; and 4,216,860. The disclosures of the aforementioned U.S. patents are all incorporated herein by reference.

Unfortunately, most of the aforementioned devices suffer from certain disadvantages attendant to "tear-away" or "peel-away" sealing means including progressively diminished integrity of the seal, stress-induced fatigue or wear of the sealing means following repeated opening and closing of the package, and difficulty of access to persons of diminished dexterity or physical ability. The present invention is directed to an improved, child-resistant blister package device which overcomes the attendant disadvantages of the aforementioned prior art devices by providing a blister package apparatus that, optionally, but preferably, comprises a blister package retained in a housing having a dispensing aperture blocked by a substantially rigid backing sheet. The backing sheet initially occupies a position blocking the dispensing aperture of the housing. During operation of the device, pressure exerted on at least one exposed end portion of the backing sheet imparts arcuate flexure thereto, and dislocation thereof, from blocking contact with the dispensing aperture of the housing, thereby permitting an article to be dispensed therethrough. Release of pressure on an exposed end portion of the backing sheet relaxes flexure thereof and a firm block of the dispensing aperture by the backing sheet is restored. In contrast to the aforementioned prior art devices, diminished integrity of the seal and stress-induced fatigue or wear of the sealing means do not obtain from repeated manipulation of the device.

BRIEF DESCRIPTION OF THE DRAWINGS

For a more complete understanding of the invention, reference is now directed towards the embodiments illustrated in greater detail in the accompanying drawings and described hereinbelow by way of examples of the invention.

In the drawings.

REFERENCE NUMERALS IN THE DRAWINGS

Figure 1:
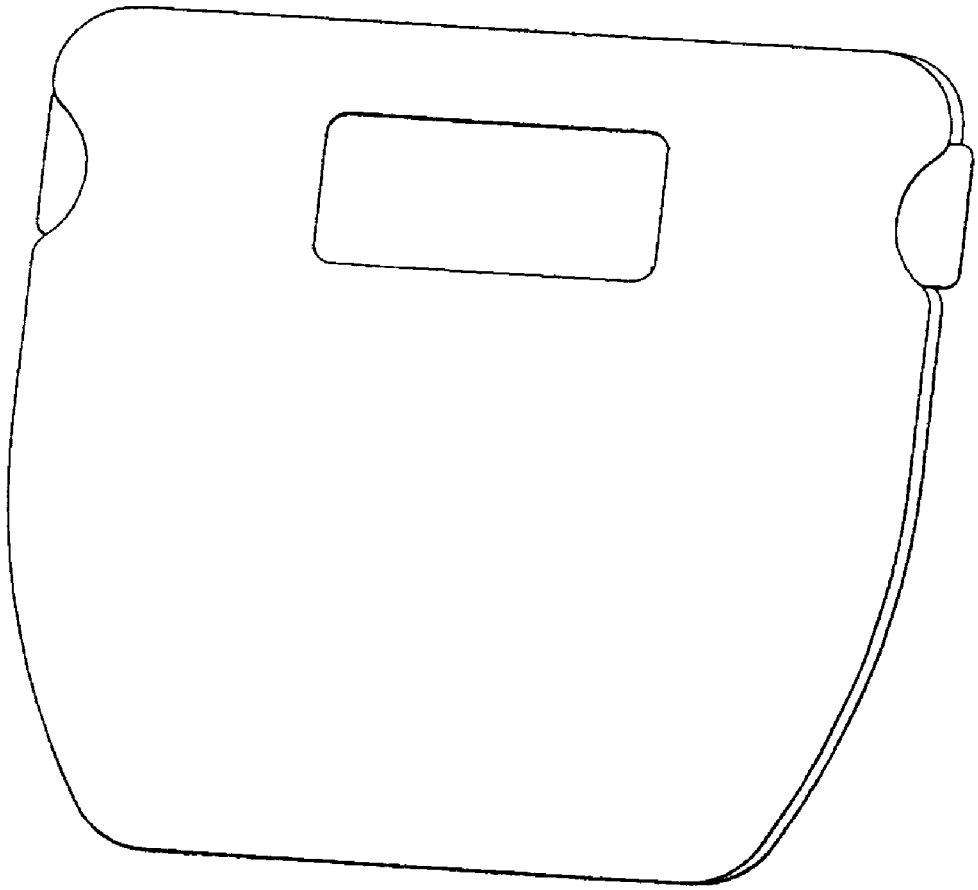
FIG. 1 is a perspective view of an embodiment of the apparatus.

1 housing
1*a* top
2 first sheet
2*a* first side
2*b* second side
3 blister cell
4 article
5 dispensing aperture
6 second sheet
6*a* first side
6*b* second side
7 parallel sidewall
8 perpendicular sidewall
9 backing sheet
9*a* side edge
9*b* end portion
10 elongate slot
11 stud

SUMMARY OF THE INVENTION

The invention provides a child-resistant apparatus for dispensing articles which comprises a housing for retaining a blister package wherein the housing comprises a dispensing aperture; optionally, but preferably, a blister package comprising at least one blister cell containing an article to be dispensed; and a substantially rigid backing sheet substantially co-extensive with, and substantially blocking, the dispensing aperture wherein the backing sheet comprises exposed end portions, such that pressure applied on either exposed end portion individually, or on both exposed end portions simultaneously of the backing sheet, imparts arcuate flexure thereto and dislocation thereof from the substantially co-extensive, and substantially blocking position, to a position where the dispensing aperture is unblocked permitting the article contained in the blister cell to be dispensed, as described hereinbelow. Release of pressure on the exposed end portion or portions of the backing sheet relaxes flexure thereof such that the substantially co-extensive, and substantially blocking position, wherein the backing sheet substantially blocks the dispensing aperture, is restored.

DETAILED DESCRIPTION OF THE INVENTION

The instant invention provides an apparatus for dispensing articles which comprises a housing for retaining a blister package wherein the housing comprises an opening therein defining a dispensing aperture; optionally, but preferably, a blister package retained by the housing wherein the blister package comprises at least one blister cell containing an article to be dispensed; and a substantially rigid backing sheet substantially co-extensive with, and substantially blocking, the dispensing aperture wherein the backing sheet comprises side edges, and exposed end portions.

Figure 2:
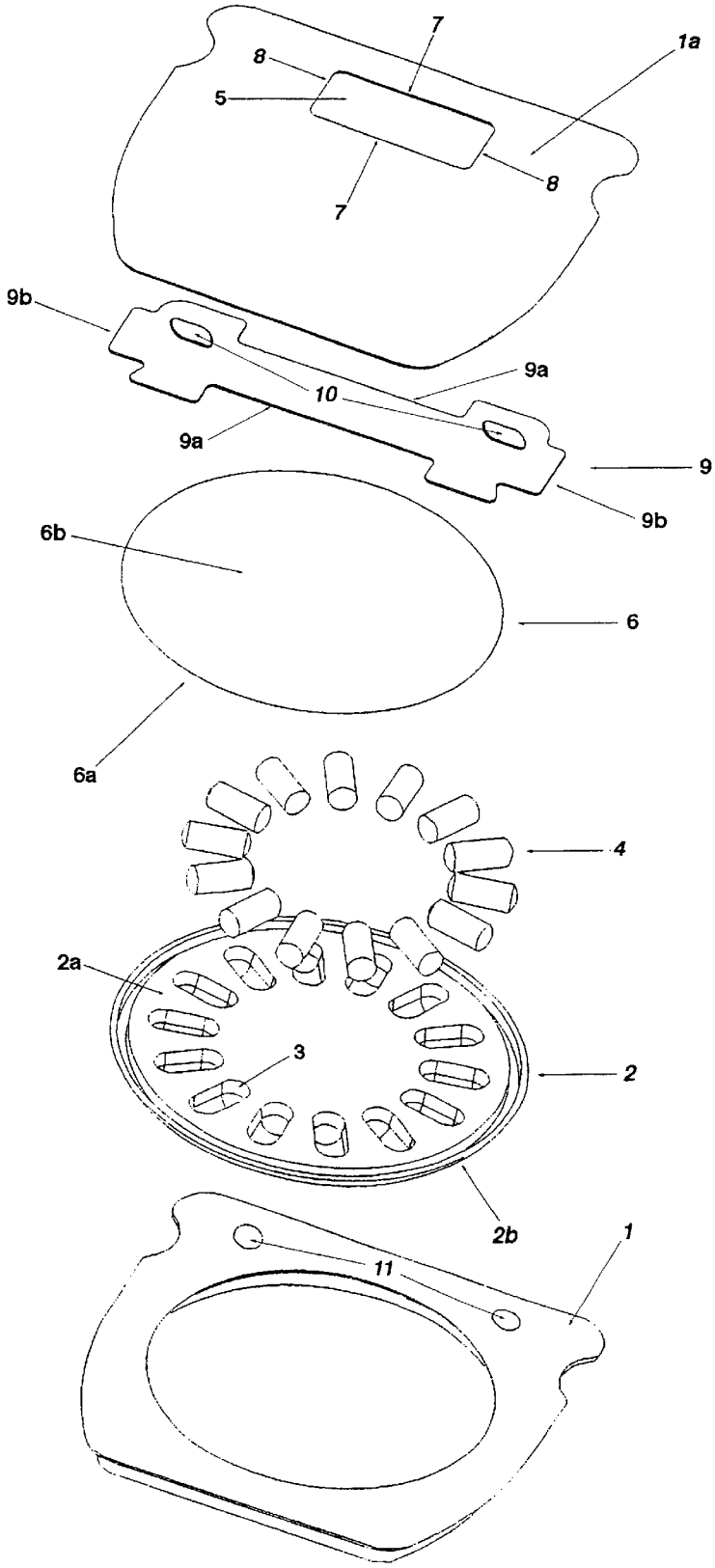
FIG. 2 is a fragmentary perspective of an embodiment of the apparatus.

The apparatus of the instant invention optionally, but preferably, comprises a conventional blister package unit that will be well known to one of ordinary skill in the art. In the practice of the instant invention, any desired shape or size blister package configuration may be employed. An exemplary package, substantially circular in shape, is depicted in fragmentary perspective in FIG. 2. As shown in FIG. 2, a conventional blister package typically comprises a first sheet 2, a second sheet 6, and articles 4 contained therein.

The first sheet 2 is formed from a generally compressible, formable material, preferably a clear, pre-formed polymeric or thermoplastic material such as polyvinyl chloride, polystyrene, polypropylene, polyethylene terephthaiate (PET), polyethylene terephthalate glycol (PETG), or amorphous polyethylene terephthalate (APET), including laminates or co-extrusions thereof, which allows pressure applied to the first sheet 2 to be transmitted to the article 4 contained therein to remove the article 4 from the blister package.

It will be appreciated by one of ordinary skill in the art that alternative polymeric or similar materials different from those set forth hereinabove or any other generally compressible, moldable material may be employed in forming the first sheet of the blister package. In general, the material comprising the first sheet 2 should be selected in accordance with the chemical and/or physical attributes of the articles to be contained therein. If desired, the first sheet 2 may comprise an opaque material, thereby preventing the article 4 contained therein from being viewed or attracting undesired attention. Furthermore, the first sheet 2 may comprise material of such density and opacity as to filter out degradative wavelengths of light, or to protect the articles 4 from inadvertent physical damage attendant to manipulation.

As shown in FIG. 2, the first sheet 2 has a first side 2*a* and a second side 2*b*. The first sheet 2 has at least one, but preferably a plurality of, generally outwardly extending blister cells 3 for accomodating the articles 4 to be dispensed. The dimensions of the blister cells 3 are generally complementary with respect to the size and shape of the articles 4 contained therein. The articles 4 contained in the blister cells 3 preferably comprise pharmaceutical or medicinal products, such as pills, tablets, capsules, syringes, suppositories, and the like. However, it is to be understood that the articles 4 need not be restricted to pharmaceutical or medicinal classifications, but may alternatively include electronic and automotive components, such as batteries, transistors, resistors, capacitors, screws, nuts, bolts or any other articles suitable for packaging in a blister-type package or container.

As shown in FIG. 2, the blister package further comprises a rupturable or puncturable substantially flat second sheet 6. The second sheet 6 is preferably puncturable by the article 4 contained within the area defined by the blister cell 3 when force is applied to an exterior portion of the blister cell 3 of the first sheet 2 and, thereby, to the article 4. One of ordinary skill in the art will appreciate that the pressure required to puncture the second sheet 6 with the article 4 is, inter alia, a necessary function of the shape and compressibility of the article 4, as well as the compressibility, thickness, and type of material from which the first sheet 2 and the second sheet 6 are formed. Normally, the required pressure is that which is capable of being imparted by one or more fingers of an individual user of the apparatus.

One of ordinary skill in the art will understand that the second sheet 6 need not always be substantially flat, but may have ridges or indentations. Preferably, the second sheet 6 is generally co-extensive with, and conforms generally in size to, the first sheet 2. However, one of ordinary skill in the art will understand that the second sheet 6 may be larger or smaller than the first sheet 2, if desired.

As shown in FIG. 2, the second sheet 6 has a first side 6*a* and a second side 6*b*. The first side 6*a* of the second sheet 6 sealingly engages at least a portion of the first side 2*a* of the first sheet 2. The sealing engagement generally does not include the opening defined by the rear of the blister cell 3. Preferably, the first side 6*a* of the second sheet 6 is heat sealed or adhesively engaged to at least a portion of the first side 2*a* of the first sheet 2. For purposes of illustrative clarity, the adhesive or heat sealing coating is not shown, however, one of ordinary skill in the art will understand that the first side 6*a* of the second sheet 6 may be sealingly engaged with a portion of the first side 2*a* of the first sheet 2 by alternative means, such as induction heating, solvent welding, or other methods that will be known, or apparent in light of the disclosure herein, to one of ordinary skill in the art.

The first sheet 2 of the blister package is sealed by the second sheet 6 which serves to retain and protect the articles 4 while they are contained inside the blister cells 3. The second sheet 6 overlies the opening defined by the rear of the blister cell 3, is substantially co-extensive with the first sheet 2, and comprises a material that is generally rupturable or puncturable by the article 4 contained in the blister cell 3 when a force is applied to the outside of the blister. Preferably, the second sheet 6 comprises a metallic foil, such as aluminum foil or similar material, which is applied to the first sheet 2 in a manner such that a protective hermetic seal between the article 4 contained in the blister cell 3 and the exterior environment is imparted. It is to be understood, however, that any other conventional material, such as plastic or paper may be successfully employed.

Although the instant invention has been depicted in reference to a generally preferred circular, or substantially circular, shape, in alternative embodiments of the invention, the blister package may be square, or substantially rectangular, in shape. In the square or substantially rectangular embodiments, the blister cell or cells may be disposed in any suitable or desirable arrangement about the blister package. In the generally preferred circular, or substantially circular, embodiment, the blister package may comprise at least one, but preferably a plurality of, blister cells preferably disposed evenly about an outer periphery of the blister package. Such an blister package arrangement is depicted in FIG. 2. One of ordinary skill in the art will readily appreciate that a conventional circular, or substantially circular, blister package, such as that depicted in FIG. 2, is normally rotatably mounted in or on a housing about a common axis such that a blister cell, when depleted of the article contained therein, may be removed from alignment with a dispensing aperture of the housing by rotational movement of the blister package about the common axis. If desired, the blister package and/or the housing may comprise alignment indices disposed on housing and/or the blister package that permit the user of the apparatus to correctly ascertain and align the relative positions of the blister cell or cells and the dispensing aperture.

The optional, but preferable, blister package is contained in a housing 1. For purposes of illustrative clarity and convenience, the housing depicted in FIG. 2 is shown as a two-piece arrangement comprising a separate top section 1*a* which, when assembled together with the housing 1, form an integral unit. It is to be understood, however, that the housing may comprise any conventional configuration suitable for retaining a blister package, including a single-piece design that does not incorporate a separate top section. The housing 1 of the instant invention is similar in appearance to a frame member and may be formed from a thermoplastic material such as polyvinyl chloride, styrene, polypropylene, or any of the other polymeric materials employed hereinabove to form the first sheet 2 of the blister package. However, one of ordinary skill in the art will understand that the housing may be formed from any material sufficiently rigid to retain and hold the blister package in place. For example, the housing can be constructed of paperboard or paperboard with a heat-seal coating or a combination of paperboard and a polymeric material. If the housing comprises an assembly of separate components comprising different materials, each or all of the components may be formed from the same material or different materials as desired. Preferably, the components of the housing are assembled by heat sealing, RF (radio frequency) or sonic welding, mechanical press fitting or other conventional means of assembly.

The components of the housing may be assembled after the blister package has been positioned inside the housing, or the housing may be designed as a pre-formed unit such that a blister package, acquired separately from the housing 1 but intended to be positioned therein by the user of the apparatus, may be removed therefrom when depleted of articles and replaced with a fresh blister package without necessitating the separate steps of dissassembly of the housing, removal of the depleted blister package, substitution thereof with a fresh blister package, and reassembly of the housing. If the housing 1 comprises such a pre-formed unit designed to be charged with a blister package acquired separately from the housing, one of ordinary skill in the art would understand that the apparatus should be designed so that the child-resistant attributes of the instant invention are retained. This may be accomplished by requiring, inter alia, that the level of strength and/or sophistication necessary to remove and replace the depleted blister package is such that only an adult would be able to perform the requisite operations.

As depicted in FIG. 2, the housing 1 surrounds at least a portion of the optional, but preferable, blister package and is of appropriate shape and size to accomodate the blister package containing the articles 4 to be dispensed. The housing 1 further comprises an opening therein defining a dispensing aperture 5, which permits passage therethrough of the article 4 contained in the blister cell 3. It is to be understood that the dispensing aperture 5 may be sized in a manner appropriate to accomodate the passage therethrough, and dispensation thereof, of a single article 4 or, if desired, multiple articles simultaneously. In the generally preferred circular or substantially circular embodiment depicted in FIG. 2, the dispensing aperture 5 comprises an opening in the housing 1 defined by elongate parallel sidewalls 7, and perpendicular sidewalls 8 in the rear of the housing 1. It is to be understood, however, that the embodiment of the dispensing aperture 5 depicted in FIG. 2, is for purposes of exemplification only, and that the dispensing aperture 5 may comprise any desired shape or size suitable for the passage therethrough, and dispensation thereof, of the article 4, and may be disposed at any appropriate or desired location in the housing 1.

Figure 3:
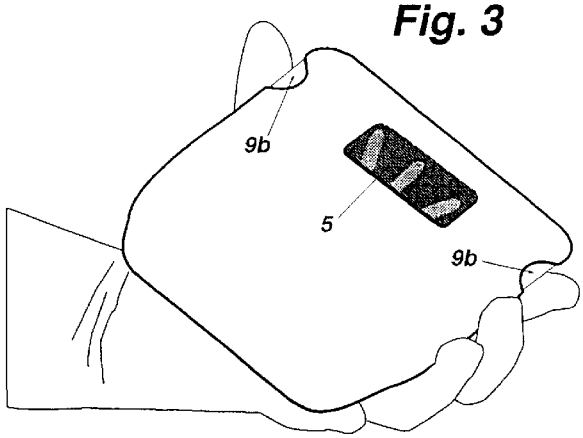
FIGS. 3, 4 and 5 depict operational steps in the manipulation of an embodiment of the apparatus.

The apparatus further comprises a substantially rigid backing sheet 9 substantially co-extensive with, and substantially blocking the dispensing aperture 5 of the housing 1, wherein the backing sheet 9 comprises side edges 9*a*, and exposed end portions 9*b*. As shown in FIG. 3, the backing sheet 9 imparts a secure, child-resistant seal of the dispensing aperture 5, thereby preventing unintended manipulation of the apparatus resulting in the undesired dispensation of an article 4 from the blister cell 3. One of ordinary skill in the art will appreciate that the backing sheet 9 should be operationally secured in a manner such that it is normally incapable of being removed from the apparatus, thereby preserving the child-resistant attributes of the device. In the exemplary embodiment depicted in FIG. 2, the backing sheet 9 is interposed between the top 1*a* of the housing, the blister package 2, and the housing 1. In the embodiment thus depicted, the backing sheet 9 is operationally secured within the housing 1 by the engagement of the elongate slots 10 of the backing sheet 9 with the studs 11. When the exemplary apparatus shown in fragmentary perspective in FIG. 2 is assembled, the studs 11 secure the backing sheet 9 inside the housing 1 by occupying a portion of the area defined by the interior of the elongate slots 10. The positioning of the studs 11 within the area defined by the interior of the elongate slots 10 is such that, when pressure is applied to one of the exposed end portions 9*b* individually, or to both of the exposed end portions 9*b* simultaneously, in a direction parallel to the side edges 9*a* of the backing sheet 9, the backing sheet 9 is permitted a free range of movement, with concomitant arcuate flexure thereof, limited to an area defined by the the length of the interior of the elongate slots 10. The positioning of the studs 11 inside the area defined by the interior of the elongate slots 10, however, is also such that, when one of the exposed end portions 9*b* is pulled in an effort to remove the backing sheet 9 from the housing 1, the studs 11 preclude movement of the backing sheet 9, and concomitant removal thereof, in a direction away from the housing 1. In FIG. 2, for purposes of illustrative clarity, the studs 11 are depicted as being disposed on the housing 1, however, one of ordinary skill in the art would understand that, if desired, the studs 11 may also be disposed on the underside of the top 1*a* of the housing 1, or, alternatively, on both the underside of the top 1*a* of the housing and the housing 1. It is to be understood that the embodiment depicted in FIG 2 is for exemplary purposes only, and that alternative conventional means similar to, or different from, that shown in FIG, 2 for operationally securing the backing sheet 9 to the housing 1 may be employed. For example, the studs 11 may also comprise a spot-welded segment or segments in, on, or through the housing 1 and the top 1*a* of the housing, or male-female juncture means disposed on both the housing 1 and the top 1*a* of the housing. It is to be further understood that, if desired, one of the exposed end portions 9*b* may be fixed in a non-movable position, thereby permitting movement of only the other exposed end portion 9*b*. The backing sheet 9 may be constructed of either transparent or opaque material, however, for reasons of operational security where children may be involved, an opaque material is generally preferable. The types of materials that may be used to form the backing sheet 9 may include those polymeric materials employed hereinabove to form the first sheet 2 of the blister package. It is to be understood, however, that any suitable material may be employed to form backing sheet 9 which is substantially rigid, yet is of sufficient resilience to permit arcuate flexure of the backing sheet 9 upon the exertion of pressure to the exposed end portion or portions 9*b* thereof, and relaxation thereof upon release of pressure to the exposed end portion or portions 9*b* thereof. The pressure required for such manipulation is normally that which is capable of being imparted, for example, by the thumb and forefinger of an individual user of the apparatus.

Figure 4:
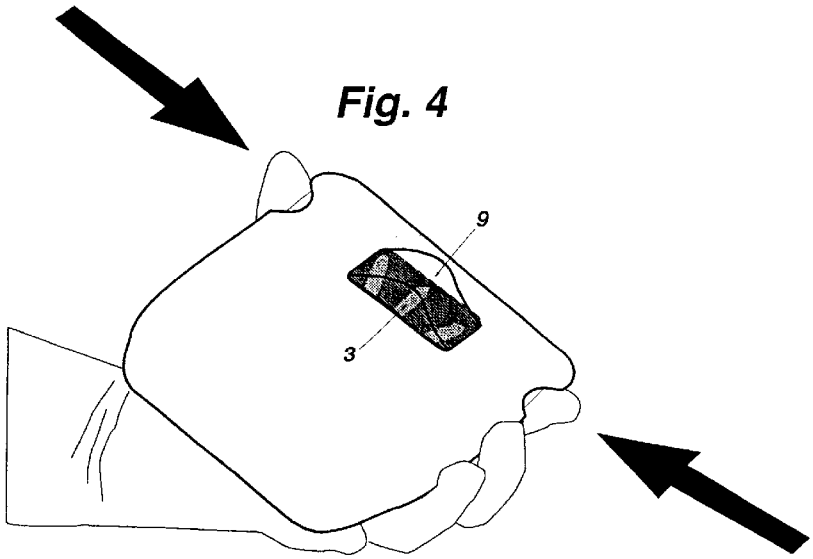
Figure 5:
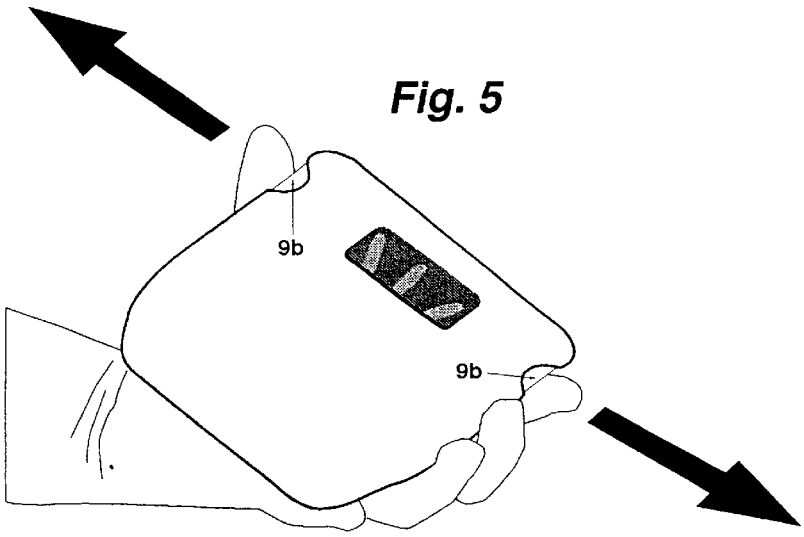

The apparatus may be manipulated as depicted in FIGS. 3, 4 and 5. The apparatus is first positioned in a manner such that facile operation of the mechanism may be performed by the user thereof. As shown in FIG. 3, this may be accomplished by preferably orienting the apparatus in the palm of the hand of the user with the dispensing aperture 5 facing upward. Pressure is then exerted on an exposed end portion 9*b* individually or, preferably by the thumb and forefinger, on both exposed end portions 9*b* simultaneously, in a direction parallel to the side edges 9*a* of the backing sheet 9, such that arcuate flexure of the backing sheet 9 and dislocation thereof from the substantially co-extensive, and substantially blocking position, to a position wherein the dispensing aperture 5 is unblocked, results. As depicted in FIG. 4, the article 4 contained in the blister cell 3 of the blister package may now be dispensed therefrom as described hereinabove. Finally, as shown in FIG. 5, the backing sheet 9 may be subsequently returned to the position wherein the backing sheet 9 is substantially co-extensive with, and substantially blocks, the dispensing aperture 5, by releasing pressure on either exposed end portion 9*b* individually, or on both exposed end portions 9*b* simultaneously, of the backing sheet 9.

It will be appreciated by one of ordinary skill in the art that, while the instant invention and the operational aspects thereof have been described hereinabove with respect to certain embodiments, other variations and modifications may also be made or incorporated thereunto without departing from the scope and spirit of the invention.

What is claim is:

1. An apparatus for dispensing articles which comprises:

a housing for retaining a blister package, said housing having an opening therein defining a dispensing aperture;

a blister package retained by said housing wherein said blister package comprises at least one blister cell containing an article to be dispensed; and a substantially rigid backing sheet substantially co-extensive with, and substantially blocking, said dispensing aperture wherein said backing sheet comprises side edges, and exposed end portions, such that;

pressure applied in a direction parallel to said side edges upon either exposed end portion individually, or on both exposed end portions simultaneously, of said backing sheet, imparts arcuate flexure thereto, and dislocation thereof, from said substantially co-extensive, and substantially blocking position, to a position wherein said dispensing aperture is unblocked, permitting said article contained in said blister cell to be dispensed therethrough; and release of pressure on either exposed end portion individually, or on both exposed end portions simultaneously, of said backing sheet relaxes arcuate flexure thereof such that said substantially co-extensive, and substantially blocking position, wherein said backing sheet substantially blocks said dispensing aperture, is restored.

2. An apparatus of claim 1 wherein said blister package is circular, or substantially circular, in shape.

3. A housing for retaining a blister package, said housing having an opening therein defining a dispensing aperture, wherein said housing comprises:

a substantially rigid backing sheet substantially co-extensive with, and substantially blocking, said dispensing aperture wherein said backing sheet comprises side edges, and exposed end portions, such that;

pressure applied in a direction parallel to said side edges upon either exposed end portion individually, or on both exposed end portions simultaneously, of said backing sheet, imparts arcuate flexure thereto, and dislocation thereof, from said substantially co-extensive, and substantially blocking position, to a position wherein said dispensing aperture is unblocked; and release of pressure on either exposed end portion individually, or on both exposed end portions simultaneously, of said backing sheet relaxes arcuate flexure thereof such that said substantially co-extensive, and substantially blocking position, wherein said backing sheet substantially blocks said dispensing aperture, is restored.

4. An apparatus for dispensing articles which comprises:

a substantially circular housing for retaining a blister package, said housing having an opening therein defining a dispensing aperture;

a circular blister package retained by said housing wherein said blister package comprises an outer periphery, and a plurality of blister cells disposed evenly about said outer periphery, said blister cells containing articles to be dispensed; and a substantially rigid backing sheet substantially co-extensive with, and substantially blocking, said dispensing aperture wherein said backing sheet comprises side edges, and exposed end portions, such that;

pressure applied in a direction parallel to said side edges upon either exposed end portion individually, or on both exposed end portions simultaneously, of said backing sheet, imparts arcuate flexure thereto, and dislocation thereof, from said substantially co-extensive, and substantially blocking position, to a position wherein said dispensing aperture is unblocked, permitting said article contained in said blister cell to be dispensed therethrough; and release of pressure on either exposed end portion individually, or on both exposed end portions simultaneously, of said backing sheet relaxes arcuate flexure thereof such that said substantially co-extensive, and substantially blocking position, wherein said backing sheet substantially blocks said dispensing aperture, is restored.

* * * * *